US007021218B2

(12) United States Patent
Davis

(10) Patent No.: US 7,021,218 B2
(45) Date of Patent: Apr. 4, 2006

(54) SAFETY AND PERFORMANCE ENHANCEMENT CIRCUIT FOR PRIMARY EXPLOSIVE DETONATORS

(75) Inventor: Ronald W. Davis, Tracy, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/302,103

(22) Filed: Nov. 21, 2002

(65) Prior Publication Data

US 2004/0099171 A1 May 27, 2004

(51) Int. Cl.

| | |
|---|---|
| ***F23Q 7/24*** | (2006.01) |
| ***F23Q 7/02*** | (2006.01) |
| ***F42C 11/00*** | (2006.01) |
| ***F42C 15/40*** | (2006.01) |

(52) U.S. Cl. ..... 102/218; 102/202.1; 102/202.7; 361/251

(58) Field of Classification Search ..... 102/202.2, 102/218, 220, 202.1, 202.5, 202.7, 206, 217; 361/251

See application file for complete search history.

(56) References Cited

U.S. PATENT DOCUMENTS

| | | | | |
|---|---|---|---|---|
| 3,752,081 | A * | 8/1973 | McKeown et al. | 102/70.2 R |
| 3,757,697 | A * | 9/1973 | Phinney | 102/70.2 R |
| 4,104,970 | A * | 8/1978 | Petersen et al. | 102/220 |
| 4,493,259 | A | 1/1985 | Munzel | |
| 4,762,067 | A | 8/1988 | Barker et al. | |
| 4,870,902 | A * | 10/1989 | Simon et al. | 102/201 |
| 5,094,167 | A * | 3/1992 | Hendley, Jr. | 102/218 |
| 5,144,893 | A | 9/1992 | Zeman et al. | |
| 5,367,428 | A * | 11/1994 | Aresco et al. | 361/251 |
| 5,460,093 | A * | 10/1995 | Prinz et al. | 102/217 |
| 5,533,454 | A * | 7/1996 | Ellis et al. | 102/202.1 |
| 5,905,226 | A * | 5/1999 | Baginski | 102/202.2 |
| 6,192,802 | B1 * | 2/2001 | Baginski | 102/202.2 |
| 6,268,775 | B1 | 7/2001 | Patti | |
| 2004/0003743 | A1 * | 1/2004 | Brooks et al. | 102/202.7 |
| 2005/0178282 | A1 * | 8/2005 | Brooks et al. | 102/202.7 |

* cited by examiner

*Primary Examiner*—Michael J. Carone
*Assistant Examiner*—James S. Bergin
(74) *Attorney, Agent, or Firm*—James S. Tak; Alan H. Thompson

(57) ABSTRACT

A safety and performance enhancement arrangement for primary explosive detonators. This arrangement involves a circuit containing an energy storage capacitor and preset self-trigger to protect the primary explosive detonator from electrostatic discharge (ESD). The circuit does not discharge into the detonator until a sufficient level of charge is acquired on the capacitor. The circuit parameters are designed so that normal ESD environments cannot charge the protection circuit to a level to achieve discharge. When functioned, the performance of the detonator is also improved because of the close coupling of the stored energy.

15 Claims, 1 Drawing Sheet

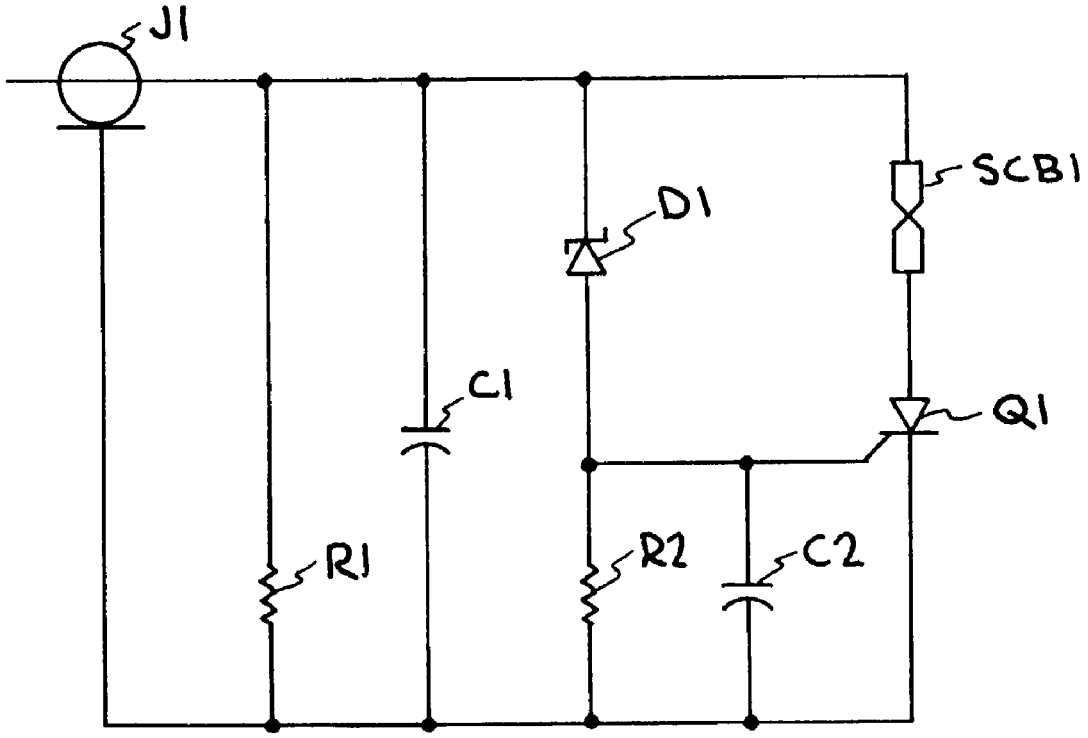
J1
SCB1
D1
C1
Q1
R1
R2
C2

SAFETY AND PERFORMANCE ENHANCEMENT CIRCUIT FOR PRIMARY EXPLOSIVE DETONATORS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The invention relates to safety devices for primary explosive detonators, particularly to a circuit to protect a primary explosive detonator from electro-static discharge (ESD), and more particularly to a circuit containing an energy storage capacitor and preset self-trigger to protect the primary explosive detonator from ESD.

Detonators, such as the Silicon Bridgewire (SCB) detonator technology is known in the art. SCB detonators are sensitive to electro-static discharge (ESD) and are not fast functioning devices. Traditional ESD protection for SCBs incorporate zener diodes into the structure which have the disadvantage of degrading the performance. In an attempt to enhance the performance of the device, a small circuit, made in accordance with the present invention, was incorporated with the detonator for the purpose of delivering energy very rapidly. This circuit also has the advantage of providing ESD protection to the detonator. Primary explosive detonators are used in a number of applications, such as in the automotive airbag industry, and the circuit of this invention can contribute to public safety by enhancing the safety of the device against pre-fire, and the performance of the device against misfire. Basically, the circuit of the present invention includes an energy storage capacitor operatively connected to a primary explosive detonator, a voltage sensing trigger, and a switch device.

SUMMARY OF THE INVENTION

It is an object of the present invention to provide a safety and enhancement circuit for primary explosive detonators.

A further object of the invention is to provide a circuit for protecting a primary explosive detonator from electro-static discharge.

Another object of the invention is to provide a circuit containing an energy storage capacitor and preset self-trigger to protect a primary explosive detonator from electro-static discharge.

Another object of the invention is to provide a circuit designed to not discharge into an associated detonator until a sufficient level of charge is acquired on a capacitor of the circuit.

Another object of the invention is to provide a circuit with parameters designed such that normal electro-static discharge environments cannot charge the protection circuit to a level to achieve discharge.

Other objects and advantages of the invention will become apparent to those skilled in the art based on the description and illustration of the invention. Basically, the invention involves a safety and performance enhancement circuit for primary explosive detonators. To enhance the performance of a detonator, such as a Silicon Bridgewire (SCB), a circuit has been incorporated with the detonator for the purpose of delivering energy very rapidly while providing electro-static discharge protector to the detonator. In addition to a primary explosive detonator, such as an SCB, the invention involves specific components including an energy storage capacitor, a voltage sensing trigger, and a switch device.

BRIEF DESCRIPTION OF THE DRAWINGS

The accompanying drawings, which are incorporated into and form a part of the disclosure, illustrate an embodiment of the invention and, together with the description, serve to explain the principles of the invention.

The single FIGURE schematically illustrates an embodiment of the safety and performance enhancement circuit for a primary explosive detonator made in accordance with the invention.

DETAILED DESCRIPTION OF THE INVENTION

The present invention is directed to a safety and performance enhancement circuit for primary detonators. This invention uses a local circuit containing an energy storage capacitor and a preset self-trigger to protect a primary explosive detonator from electro-static discharge (ESD). The circuit is designed to not discharge into the detonator until a sufficient level of charge is acquired on the capacitor. The circuit parameters are designed so that normal ESD environments cannot charge the protective circuit to a level to achieve discharge. When functioned, the performance of the detonator is also improved because of the close coupling of the stored energy. As pointed out above, primary explosive detonators are used in a number of applications, and safety of such devices can be enhanced by this invention. For example, primary explosive detonators are utilized in the automotive airbag industry, and the invention can improve safety of such devices against pre-fire and the performance of the device against misfire. The circuit of this invention enables when incorporated into an explosive detonator, such as a Silicon Bridgewire (SCB) detonator, the delivery of energy very rapidly to the detonator, while providing ESD protection to the detonator.

The invention is essentially a circuit that is incorporated into the package of a primary explosive detonator. Listed hereinafter are the key features and the specific components of a prototype, as illustrated in the single FIGURE, that were used to implement these functions:

1. A primary explosive detonator, identified, for example, and indicated at as a 50B1A silicon bridgewire (SCB1).
2. An energy storage capacitor, identified as a 3.3 μF capacitor, and indicated at C1.
3. A voltage sensing trigger composed of a diode identified as an IN976, 43 volt diode, and indicated at D1, a resistor identified as a 10 Ω resistor, and indicated at R2, and a capacitor, identified as a 0.1 μF capacitor, and indicated at C2.
4. A switch device, identified as a 2N2329 trigger or switch, and indicated at Q1.

The above listed represent the essential elements of the invention. The actual implementation of these functions may be done any number of ways. For the prototype, shown in the FIGURE and used to verify the invention, specific components were chosen. However, all the essential elements listed above are incorporated together in one assembly that offers the performance and safety enhancements.

The circuit illustrated in the FIGURE operates by applying a voltage to the input connector (BNC) indicated at J1. When this is done, capacitor C1 will begin to charge. If the applied voltage is sufficient to charge capacitor C1 to exceed the breakdown voltage of diode D1, then a trigger signal will be delivered to the trigger Q1. When this occurs, trigger Q1 will conduct and allow capacitor C1 to discharge through detonator SCB1, which will function the detonator.

If the input voltage is insufficient to charge capacitor C1 to the breakdown voltage of diode D1, then the circuit will not trigger and the energy will be dissipated through a bleeder resistor R1, a 1KΩ resistor. Resistor R2 and capacitor C2 are included in the trigger circuit and are intended to improve the noise immunity.

In the prototype circuit, the 3.3 μF capacitor C1 is used to store about 3 mJ ($E=\frac{1}{2}CV^2$) when charged to 43 volts (the breakdown voltage of diode D1. The 50B1A silicon bridgewire SCB1 requires approximately 1 mJ to function. This allows for sufficient margin of operation.

The electro-static discharge (ESD) protection of the SCB1 detonator is a result of the capacitor C1 being located at the input to the circuit. ESD is normally characterized as a small capacitance charged to a large voltage. When this threat is applied to the detonator circuit, the transfer that results is dominated by a transfer of charge rather than a transfer of energy. A typical ESD threat (standard man model) of 600 pF charged to 25 kV represents about 15 μC of charge (Q=CV); however, in order to charge the 3.3 μF capacitor C1 to the 43 volts trigger level of diode D1, requires about 142 μC. As a result, this ESD threat is insufficient to fire the circuit even though the ESD threat contains sufficient energy (187 mJ).

One other situation that may occur should be noted. If the threat is discharged through sufficient inductance, then the threat can theoretically charge the input capacitance to double the threat charge due to "ringing" of the circuit. In this case, the charge would be 30 μC, again insufficient to charge and fire the detonator.

The performance of the primary detonator is also increased by the close coupling of the firing circuit. This is due to the fact that the discharge path allows the current to rise quickly rather than being limited by the impedance of long cables, as would be the case in a typical firing system, which does not include the circuit of this invention. This rapid discharge capability increases the performance by lowering the time required for the detonator to fire.

The design of the illustrated prototype circuit represents only a specific design solution that incorporates the essential elements of the invention. It should be noted that different bridgewires require different energies and different systems may require different operating voltages. As a result, each application is likely to vary in design, form and packaging; however all applications of this invention will require the incorporation of all the above described essential elements in some form.

It has thus been shown that the present invention provides safety and performance enhancement for primary explosive detonators. The protection circuit of this invention contains an energy storage capacitor and a preset self-trigger which protect the detonator from electrostatic discharge, and due to the close coupling of the stored energy to the detonator, the performance of the detonator is also improved.

While a single embodiment of a circuit of the invention has been illustrated and described, along with various parameters to exemplify and teach the principles of the invention, such are not intended to be limiting. Modifications and changes may become apparent to those skilled in the art, and it is intended that the invention be limited only by the scope of the appended claims.

What is claimed is:

1. A safety and performance enhancement circuit for primary explosive detonators sensitive to electro-static discharge, including:

an energy storage capacitor adapted to be connected to a primary explosive detonator, and adapted to store an electrical charge sufficient to fire said primary explosive detonator and associated with a threshold applied voltage, said energy storage capacitor located at an input of said circuit exposed to electro-static discharge sources to directly buffer said primary explosive detonator from electro-static discharge, a voltage sensing trigger operatively connected to said energy storage capacitor and adapted to self-trigger at the threshold applied voltage whereupon a trigger signal is produced, and a switch device operatively connected to said voltage sensing trigger, said energy storage capacitor, and said primary explosive detonator, wherein said switch device switches the electrical charge from said energy storage capacitor directly to said primary explosive detonator in response to receiving the trigger signal from said voltage sensing trigger to electrically initiate said primary explosive detonator.

2. The circuit of claim 1, wherein said voltage sensing trigger includes a diode having a breakdown voltage set as the threshold applied voltage.

3. The circuit of claim 2, wherein said voltage sensing trigger further includes a resistor and a capacitor which are connected in said circuit to improve the noise immunity.

4. The circuit of claim 1, in combination with a primary explosive detonator connected to both the energy storage capacitor and said switch device.

5. The circuit of claim 4, wherein said primary explosive detonator comprises a bridgewire detonator.

6. The circuit of claim 5, wherein said bridgewire detonator comprises a silicon bridgewire.

7. In a bridgewire detonator system sensitive to electro-static discharge, the improvement comprising:

a circuit for providing the bridgewire detonator system with protection from electro-static discharge, said circuit including:

an energy storage capacitor adapted to store an electrical charge sufficient to electrically initiate the bridgewire detonator and associated with a threshold applied voltage, said energy storage capacitor located at an input of said circuit exposed to electro-static discharge sources to directly buffer said bridgewire detonator system from electro-static discharge;

a voltage sensing trigger adapted to self-trigger at the threshold applied voltage whereupon a trigger signal is produced; and a switch device adapted to switch the electrical charge from the energy storage capacitor directly to the bridgewire detonator upon receiving the trigger signal from the voltage sensing trigger to electrically initiate said bridgewire detonator.

8. The system of claim 7, wherein said circuit additionally includes a bleeder resistor operatively connected intermediate said energy storage capacitor and a power source.

9. The system of claim 7, wherein said voltage sensing trigger includes a diode having a breakdown voltage set as the threshold applied voltage, a resistor and a capacitor.

10. The system of claim 9, wherein said resistor and said capacitor of said voltage sensing trigger are operatively connected to improve noise immunity, and wherein said diode is operatively connected to gate said switch device.

11. In a primary explosive detonator system sensitive to electro-static discharge, the improvement comprising:

a safety and performance enhancement circuit connected to a power supply with the circuit exposed by said connection to electro-static discharge sources, and operatively mounted intermediate said power supply and a primary explosive detonator to protect the detonator from electro-static discharge, wherein said circuit includes an energy storage capacitor capable of storing an electrical charge sufficient to fire the primary explosive detonator and associated with a threshold applied voltage, said energy storage capacitor located at an input of said circuit connected to said power supply and exposed to said electro-static discharge sources to directly buffer said primary explosive detonator system from electro-static discharge; and a preset self-trigger assembly operably connected to the energy storage capacitor and adapted to self-trigger at the threshold applied voltage so as to initiate discharging of the electrical charge from the energy storage capacitor directly to the primary explosive detonator to electrically initiate said primary explosive detonator.

12. The system of claim 11, wherein said preset self-trigger assembly includes a voltage sensing trigger and a switch device.

13. The system of claim 12, wherein said voltage sensing trigger includes a diode having a preset breakdown voltage as the threshold applied voltage, a resistor and a capacitor.

14. The system of claim 13, wherein said resistor and said capacitor are connected in the circuit to improve noise immunity.

15. The system of claim 11, additionally including a bleeder resistor operatively connected intermediate a power source and said energy storage capacitor.

* * * * *